US005530997A

United States Patent [19]

Tessari

[11] Patent Number: 5,530,997

[45] Date of Patent: Jul. 2, 1996

[54] LEVER PARTICULARLY FOR SPORTS SHOES

[75] Inventor: Pino Tessari, Riese Pio X, Italy

[73] Assignee: Nordica S.p.A., Trevignano, Italy

[21] Appl. No.: 498,815

[22] Filed: Jul. 6, 1995

[30] Foreign Application Priority Data

Jul. 13, 1994 [IT] Italy ..... TV94U037 U

[51] Int. Cl.[6] ..... A43C 11/00

[52] U.S. Cl. ..... 24/68 SK; 24/70 SK; 24/71 SK; 24/585

[58] Field of Search ..... 24/68 SK, 70 SK, 24/71 SK, 69 SK, 498, 504, 585, 68 CD, 16 PB; 36/50.1

[56] References Cited

U.S. PATENT DOCUMENTS 3,113,362 12/1963 Petruzziello ..... 24/585
4,304,055 12/1981 Hanson ..... 24/68 SK
4,310,951 1/1982 Riedel ..... 36/50.1
4,683,620 8/1987 Valsecchi et al. ..... 24/68 SK

*Primary Examiner*—Victor N. Sakran
*Attorney, Agent, or Firm*—Guido Modiano; Albert Josif

[57] ABSTRACT

Lever for sports shoes, constituted by a free lever arm, one end whereof engages an abutment associated with a first flap to be fastened. A toothed strap is freely pivoted to the lever arm and selectively interacts, in a ratchet-like manner, with a first tooth of a pawl rigidly coupled to a second flap to be joined. The strap has a larger last tooth adapted to interfere with the first tooth of the pawl. The pawl has a second safety tooth for locking the larger last tooth of the strap once it has disengaged from the first tooth, so as to prevent its extraction.

6 Claims, 1 Drawing Sheet

LEVER PARTICULARLY FOR SPORTS SHOES

BACKGROUND OF THE INVENTION

The present invention relates to a lever, particularly for sports shoes.

Various kinds of lever for sports shoes are currently known, which include a lever constituted by a lever arm that is free, that is to say it is not articulated to a base, and engages, at one end, an abutment which is the only part associated with the first flap to be secured.

A toothed strap is also freely pivoted at the lever arm and selectively interacts in a ratchet-like manner with a tooth of a pawl that is in turn rigidly coupled to the second flap to be joined.

A drawback of conventional levers is that since the lever arm is free, any extraction of the strap from the pawl entails the loss of said strap and the consequent impossibility of fastening the shoe again.

As a partial solution to this drawback, it is known to provide, for the toothed surface, a larger last tooth so as to interfere with the tooth of the pawl which, even if activated, continues to interfere with the last tooth of the strap.

However, this solution has drawbacks: it has in fact been observed that an improper pressure applied at the pawl may cause the pawl to be passed by the larger last tooth of the strap, and this causes the extraction of the strap and thus its possible loss.

SUMMARY OF THE INVENTION

The aim of the present invention is to solve the described technical problems, eliminating the drawbacks of the prior art by providing a lever constituted by a free lever arm and by a toothed strap cooperating, in a ratchet-like manner, with a pawl, wherein the strap cannot be extracted from the pawl by intentional or accidental pressures applied thereto.

Within the scope of this aim, an important object is to provide a lever that is structurally simple and easy to industrialize.

Another object is to provide a lever that associates with the preceding characteristics that of being reliable and safe in use and of allowing optimum mutual fastening of the flaps.

This aim, these objects, and others which will become apparent hereinafter are achieved by a lever, particularly for sports shoes, comprising a free lever arm, one end whereof engages an abutment associated with a first flap to be fastened, a toothed strap being freely pivoted to said lever arm, said strap selectively interacting, in a ratchet-like manner, with a first tooth of a pawl rigidly coupled to a second flap to be joined, said strap having a larger last tooth adapted to interfere with said first tooth, said pawl having a second safety tooth for locking said last tooth of said strap, preventing its extraction once said first tooth has disengaged.

BRIEF DESCRIPTION OF THE DRAWINGS

Further characteristics and advantages of the present invention will become apparent from the following description of a particular embodiment thereof, illustrated in the accompanying drawing, wherein.

DESCRIPTION OF THE PREFERRED EMBODIMENTS

Figure 1:
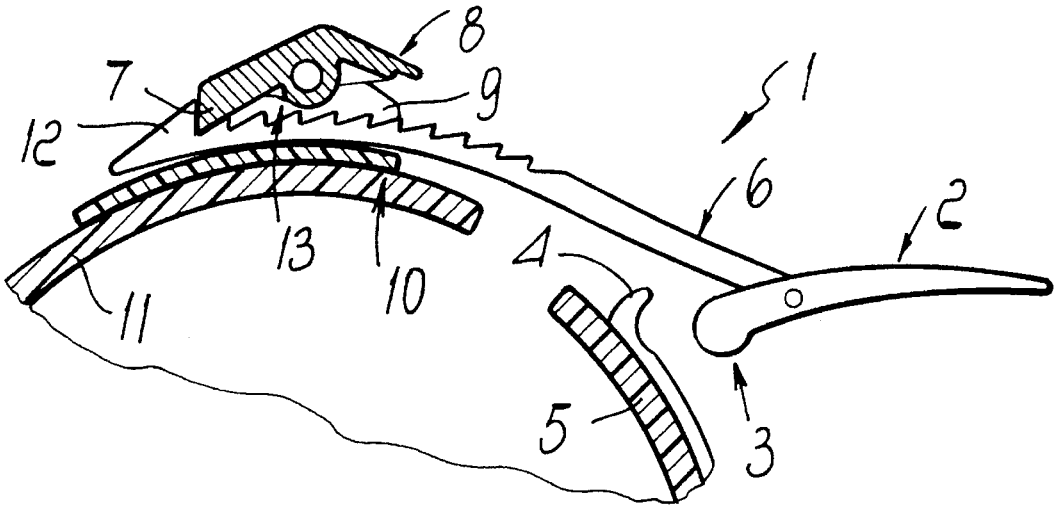
FIG. 1 is a partially sectional side view of the lever in the condition for normal use.
Figure 2:
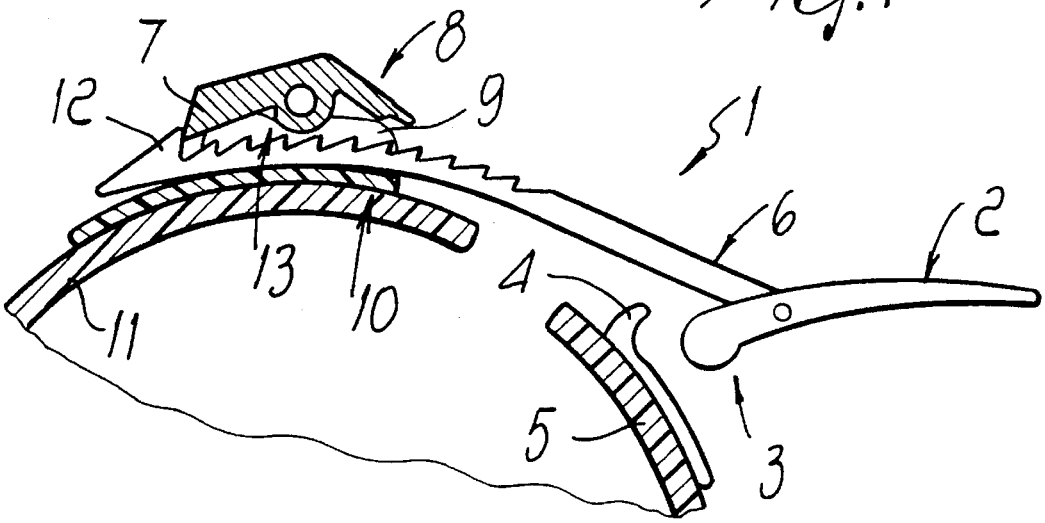
FIGS. 2 and 3 are views, similar to the preceding one, of the condition wherein the larger last tooth of the strap passes beyond the first tooth of the pawl and said last tooth is consequently locked on the second tooth of said pawl.

With reference to the above figures, the reference numeral 1 designates the lever, which is constituted by a free lever arm 2 having an end 3 that engages an abutment 4 associated with a first flap 5 to be fastened.

A toothed strap 6 is transversely and freely pivoted to the lever arm 2 and selectively interacts, in a ratchet-like manner, with a first tooth 7 of a pawl 8 that is transversely pivoted, in contrast with an optional flexible element, between the shoulders 9 of a base 10 associatable with the second flap 11 to be fastened.

The toothed strap 6 is provided, at its end, with a last tooth 12 that is larger than the other ones, so as to interfere with the first tooth 7 of the pawl 8, as shown in FIG. 1.

In the illustrated embodiment, a second safety tooth 13 is formed inside the pawl 8 proximate to the axis about which said pawl is pivoted to the shoulders 9 of the base 10; the distance between the top of the second tooth 13 and the upper surface of the base 10 is approximately equal to the maximum height of the last tooth 12.

Figure 3:
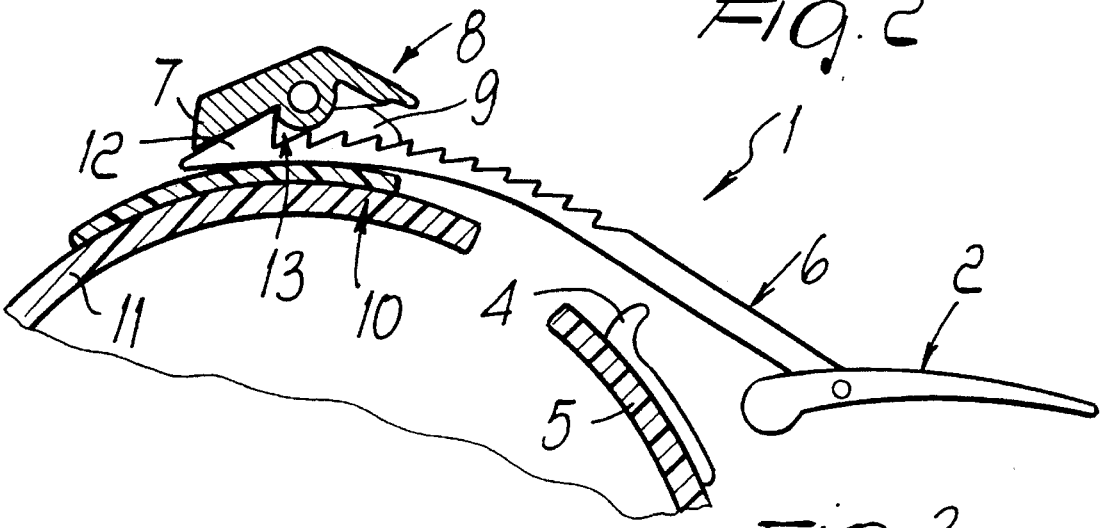

Said second tooth 13 interacts with the last tooth 12 of the toothed strap 6 if the first tooth 7 disengages accidentally from said last tooth 12: in this condition, the disengagement of the first tooth 7 from the last tooth 12 causes the extraction of the toothed strap 6, which however stops again, since the last tooth 12 engages again the second tooth 13, preventing any further extraction of said toothed strap, as shown in FIG. 3.

It has thus been observed that the invention has achieved the intended aim and objects, a lever having been provided wherein accidental extraction of the toothed strap from the pawl is not possible, thus avoiding any loss of said toothed strap.

The materials and the number of components of the lever may of course be the most convenient according to the specific requirements.

What is claimed is:

1. Lever, particularly for sports shoes, comprising a free lever arm, one end whereof engages an abutment associated with a first flap to be fastened, a toothed strap being freely pivoted to said lever arm, said strap selectively interacting, in a ratchet-like manner, with a first tooth of a pawl rigidly coupled to a second flap to be joined, said strap having a larger last tooth adapted to interfere with said first tooth, said pawl having a second safety tooth for locking said last tooth of said strap, preventing its extraction once said first tooth has disengaged.

2. Lever according to claim 1, comprising a pawl transversely pivoted between the shoulders of a base, and in contrast with an optional flexible element, said base being rigidly coupled to said second flap, a second safety tooth being formed inside said pawl.

3. Lever according to claim 2, wherein said second safety tooth is formed proximate to the axis about which said pawl is pivoted to said shoulders.

4. Lever according to claim 2, wherein said second safety tooth interacts with said larger last tooth of said strap when said first tooth of said pawl disengages from said larger last tooth towards said abutment.

5. Lever according to claim 2, wherein the interaction of said second safety tooth with said larger last tooth of said toothed strap locks said strap to said pawl, preventing its extraction towards said abutment.

6. Lever according to claim 2, wherein the distance between the top of said second tooth and the upper surface of said base is approximately equal to the maximum height of said last tooth.

* * * * *